5/27/86 XR 4,591,701

United States Patent [19]

Tokumaru

[11] Patent Number: 4,591,701

[45] Date of Patent: May 27, 1986

[54] HEAT RADIATING SHEET BODY

[76] Inventor: Sennosuke Tokumaru, 10-3, Tsujido Taiheidai 1-chome, Fujisawa-shi, Kanagawa-ken 251, Japan

[21] Appl. No.: 683,738

[22] Filed: Dec. 19, 1984

[30] Foreign Application Priority Data

Mar. 15, 1984 [JP] Japan ..... 59-48117

[51] Int. Cl.[4] ..... H05B 3/16

[52] U.S. Cl. ..... 219/543; 219/541; 219/553; 338/309; 428/214; 428/408; 427/122

[58] Field of Search ..... 219/203, 522, 345, 541, 219/543, 549, 553; 338/308, 309; 427/122; 428/214, 408

[56] References Cited

U.S. PATENT DOCUMENTS 3,978,316 8/1976 Rose et al. ..... 219/543

4,367,398 1/1983 Strube et al. ..... 219/541

*Primary Examiner*—Volodymyr Y. Mayewsky

*Attorney, Agent, or Firm*—Armstrong, Nikaido, Marmelstein & Kubovcik

[57] ABSTRACT

A heat radiating sheet body comprising a ceramic sheet, a carbon particle layer formed on the ceramic sheet and a pair of electrodes formed on the carbon particle layer, the ceramic sheet being formed in a thickness of 0.05 ~ 1 mm by paper-making of ceramic fiber, the carbon particle layer being formed by coating by a screen printing utilizing a printing medium comprising a mixture of carbon particle and a dispersing medium.

17 Claims, 8 Drawing Figures

HEAT RADIATING SHEET BODY

BACKGROUND OF THE INVENTION:

This invention relates to a heat radiating sheet body and more specifically to a very safe heat radiating sheet body which does not show any change of resistance value even when a temperature rises due to supply of electrical power and keeps radiating temperature constant.

A heat radiating sheet body has been manufactured by the following methods.

a. A basic cloth is coated or impregnated with a conductive paint.

b. A basic cloth is woven with a fabric conductive material.

c. A conductive material, such as copper tape, is fixed to a basic cloth using a sewing machine.

However, the method (a) has the disadvantage that it is very difficult to coat or impregnate the basic cloth with a conductive paint in the uniform thickness, thickness of paint coated on the cloth becomes uneven, thereby an electrical resistance value is not uniform generating fluctuation for each product and the yield of product becomes low.

Meanwhile, the methods (b) and (c) bring about increase of price due to complicated manufacturing process and are not suited for mass-production.

Particularly, a heat radiating sheet body manufactured by such existing methods (a) to (c) shows drop of electrical resistance value when it is heated through supply of electrical power, increase of electrical resistance value when it is cooled because suspension of electrical power supply and therefore easily tends to increase the amount of electrical power supplied more and more with a temperature rise due to the electrical power supply.

Accordingly, unless a temperature control apparatus is particularly provided, not only it is difficult to maintain a heat radiating sheet body to a certain temperature but also abnormal temperature rise or drop may be brought about.

Particularly when a combustible material such as synthetic resin film, synthetic fiber or woven material of natural fiber is used as the basic cloth, it has always been accompanied by a controversial problem that it cannot be free from the risk of firing under abnormal temperature rise condition and it lacks in the safety.

SUMMARY OF THE INVENTION

It is a first object of this invention to provide a heat radiating sheet body which does not show any change of electrical resistance against change of temperature.

It is a second object of this invention to provide a heat radiating sheet body which is incombustible and assures high safety.

It is a third object of this invention to provide a heat radiating sheet body which can be manufactured easily and is suited for mass-production.

It is a fourth object of this invention to provide a heat radiating sheet body which is capable of freely controlling thickness of carbon particle layer and easily setting electrical resistance value and temperature of heat radiated.

Such objects of this invention are attained by a heat radiating sheet body where a carbon particle layer is formed on the surface of a ceramic sheet and a pair of electrodes are disposed on the surface of said carbon particle layer.

DESCRIPTION OF THE PREFERRED EMBODIMENTS

Figure 1:
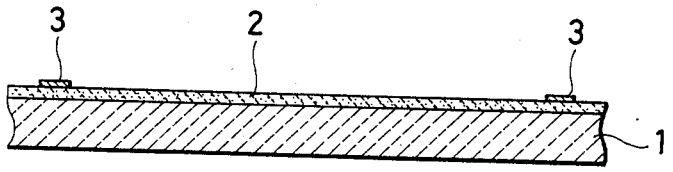
FIG. 1 is an enlarged cross-sectional view showing a first embodiment of a heat radiating sheet body of this invention.
Figure 2:
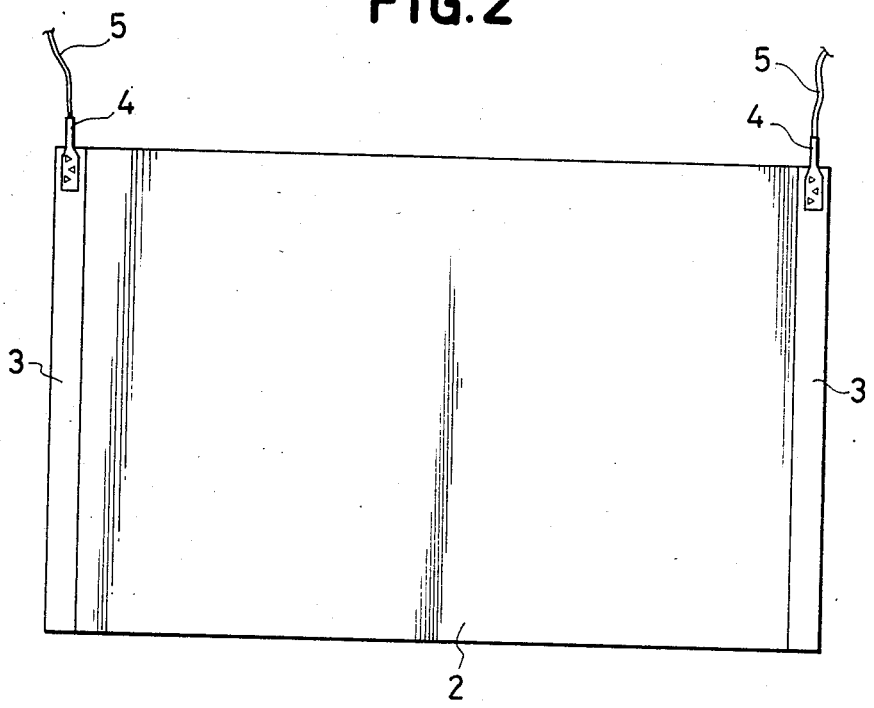
FIG. 2 is a perspective view of such heat radiating sheet body.

A heat radiating sheet body of this invention is explained with reference to embodiments shown in the figures of drawings:

FIG. 1 and FIG. 2 show a first embodiment of this invention. A heat radiating sheet body of this invention is composed of a ceramic sheet 1 and a layer 2 of carbon particle formed on the surface of said ceramic sheet.

Moreover, a pair of electrodes 3, 3 are disposed on this carbon particle layer 2.

Here, a ceramic sheet 1 is manufactured by the following processes that a paper material mainly consisting of ceramic fiber is bleached and then baked or not baked.

A ceramic fiber can be manufactured, for example, by the blowing process wherein a silica alumina, etc. is fused within an electric furnace and fused material is blown by a high speed steam or air, or by the spinning process where such fused material is caused to flow onto a roll rotating at a high speed.

A ceramic fiber obtained is explained with an example of the kaolin fiber. It has a melting point of 3200° F. (1760° C.) and has excellent resistivity to heat and still holds elasticity even when it is heated up to a high temperature, for example, up to 2400° F. (1316° C.) and is not crystallized even when heated up to 2600° F. (1426° C.). Moreover, it is not invaded by a high temperature steam. A practical heat resistivity is 2000° F. (1093° C.) for a long period and 2300° F. (1260° C.) for a short period.

A heat conductivity of kaolin fiber can be summarized as shown in the Table 1.

TABLE 1

| | Kcal/m²hr · °C. | |
|---|---|---|
| | 4.5 Kg/m² | 15 Kg/m² |
| 204° C. (400° F.) | 8.32 | 6.08 |
| 371° C. (600° F.) | 12.8 | 8.16 |
| 425° C. (800° F.) | 18.4 | 10.56 |
| 538° C. (1000° F.) | 26.24 | 13.28 |

A bauxite and various alumina silica system mineral fibers can also be manufactured by the same method.

The ceramic fiber thus obtained includes the alumino silica fiber where $Al_2O_3$: $SiO_2$ is almost 50:50~60:40 and a high alumina fiber where $Al_2O_3$: $SiO_2$ is about 70:30~95:5. These materials can also be used in this invention.

In addition to these materials, a quartz fiber, fused silica fiber and potassium titanic acid fiber manufactured in the same way can also be used.

It is also possible to add glass fiber, asbestos and inorganic fiber such as slag wool, and inorganic powder such as kaolin, clay, mica and titanium oxide and red oxide, etc. to the ceramic fiber as the sub-element.

Addition of such sub-element is usually 45% in maximum.

On the occasion of manufacturing a ceramic sheet by bleaching ceramic fiber, the bleaching technique such as paper, asbestos paper and glass fiber paper, etc. can be used.

Namely, the paper material consisting of a ceramic fiber or a mixture of ceramic fiber and sub-element of inorganic powder are dispersed in water, a dispersant, paper intensity increasing agent are added adequately in addition to a binder and these materials are formed into a paper by a paper machine.

As a binder, an organic resin or inorganic binder having the thermal decomposition resistivity and thermal resistivity are used. For example, an organic binder such as polytetrafluoroethylene resin and polyvinylalcohol and so forth, and an inorganic binder such as silicasol and so forth may be mentioned.

As the dispersant, a nonionic or cationic surface active agent is used, while as the paper intensity increasing agent, starch, cornstarch and so forth are used.

The paper formed may be cut, with or without baking, into a suitable size depending on particular use of the paper to there provide a ceramic sheet to be used for purposes of the present invention.

Whether or not the paper is to be baked is determined depending on the intended temperature at which the heat radiating sheet body of the invention is used.

Normally, when an application temperature of the heat radiating sheet body exceeds 150° C., baking is to be carried out after the paper making, but when the temperature is lower than 150° C., the baking can be done without.

The baking temperature is normally between 250°~700° C., even though it may vary depending on the particular binder used.

The organic binder, if used, can be removed by the baking.

The thickness of the ceramic sheet is 0.05~1.0 mm.

The thickness of ceramic sheet exceeding 1.0 mm is undesirable because flexibility of sheet is lost. Meanwhile, thickness under 0.05 mm is also not desirable because strength is too weak as a carrier of carbon particle layer described later.

A ceramic sheet obtained is incumbustible and has excellent heat resistivity. For example, it is easily resistive to a temperature as high as 1200° C.

Table 2 shows an example of physical nature of such ceramic sheet.

TABLE 2

| | |
|---|---|
| Weight per unit $m^2$ | 77.1 $g/m^2$ |
| Thickness | 0.29 mm |
| Density | 0.26 g/cm |
| Tensile strength (longitudinal) | 2.69 kg/15 mm |
| Tensile strength (lateral) | 1.56 kg/15 mm |
| Wet tensile strength (longitudinal) | 0.86 kg/15 mm |
| Wet tensile strength (lateral) | 0.54 kg/15 mm |
| Shearing strength (longitudinal) | 31 g |
| Shearing strength (lateral) | 35 g |
| Air permeability | 1.5 sec |

TABLE 2-continued

| | |
|---|---|
| Water absorbing capacity | 129 mm/10 min. |

A wet tensile strength means a force required for pulling a ceramic sheet sample wet by water (a belt shaped sample in the width of 15 mm) in the longitudinal or lateral direction, while a shearing strength means a force required when a sample sheet is given cutting grooves previously and it is sheared by applying a force in the vertical direction to such cutting groove.

An air permeability means a time required by a constant amount of air to permeate through a sample when the air is supplied through the sample, while a water absorbing capacity means a length between the end wet by water absorbed and the tip end of sample, measured 10 minutes after the sample end is wet in water.

The carbon particle layer 2 is formed on the surface of such ceramic sheet 1 by the following process that a printing medium, which is obtained by dispersing carbon particle into the dispersing medium, is applied to the surface of a ceramic sheet by the printing technique or a ceramic sheet is dipped into the printing medium.

As the carbon particle, various kinds of carbon blacks such as soft carbon black or hard carbon black and graphite particle can be used.

However, in this invention, carbon particle which is not subjected to oxidation treatment of the particle surface during manufacture of the carbon particle is preferably used because if oxidation treatment is carried out to the particle surface, conductivity is lost.

As the dispersing medium for dispersing carbon particle, a mixture of organic resin and organic solvent is used.

As an organic resin, a resin having thermal decomposition characteristic and thermal resistivity such as a polyethyleneterephthalate resin liquid, acrylic resin, alkyd resin, and polytetrafluoroethylene resin, etc. can be used.

Moreover, as an organic solvent, a ketone family such as acetone, etc. and aromatic compound such as toluene and xylene, etc. can be used.

A mixing ratio of carbon particle and organic resin and organic solvent is usually as shown in the following table 3.

TABLE 3

| | |
|---|---|
| Carbon particle | 10~45 part |
| Organic resin | 89-35 part |
| Organic solvent | 1-20 part |

For example, the carbon particle is dispersed into an organic resin, an organic solvent and water, as required, are added and carbon particle concentration is adjusted adequately. Thereby, a printing medium can be obtained.

As a printing technique to be employed in this invention, a silk-screen printing method or textile printing method can be employed, and the silk-screen printing method is particularly desirable.

The carbon particle layer can be formed by the silk-screen printing method as described below. As in the case of the known silk-screen printing method, a woven cloth where various fibers are woven in the equal interval like a straight grain of wood is used as screen, and the printing medium adjusted as described above is pushed through the yarns. Thereby, a carbon particle layer can be formed on the ceramic sheet.

In this invention, on the occasion of employing such silk-screen printing method, an opening between yarns of screen (aperture) and thickness of screen (about two times of yarn diameter because the yarns are woven like a straight grain of wood) are selected by adequately selecting a kind and diameter of yarn forming the screen. Moreover, a tensile strength when setting the screen to the frame is also controlled.

Here, usually yarn diameter is 23μ~50μ, screen mesh is 50~400 mesh/inch, screen thickness is 37μ~100μ, opening between yarns of screen is 30~80% and tensile strength of yarn is 0.5 kg/cm ~7.5 kg/cm.

Table 4 shows an example of such ratings.

TABLE 4

| Screen material | Tensile strength (kg/cm) | |
|---|---|---|
| | 3 | a tensile strength of 3 kg/cm is applied again after setting with a tensile strength of 3 kg/cm. |
| Polyester* | 200** | 170** |
| yarn diameter (μ) | 45 | 38 |
| screen thickness (μ) | 74 | 63 |
| opening (%) | 42 | 50 |

*polytetraethyleneterephthalate
**mesh/inch

Namely, a screen is set to the frame, for example, and the polyester yarn is extended with a tensile force of 3 kg/cm. Thereafter, (a tensile force is lowered) a tensile force of 3 kg/cm is applied again.

Thickness of film (amount of coating) on the printing medium including carbon particle applied on the ceramic sheet when such screen is used becomes as follow.

$$1000\ \text{mm}\ (A)\times 1000\ \text{mm}\ (B)\times 63\mu\ (C)\times 0.93\ (D)\times 0.5\ (E)\times 0.6\ (F)\times 0.85\ (G) = 14.9\ \text{g/m}^2$$

Here, A, B are longitudinal and lateral dimensions of screen, C is a screen thickness, D is a specific gravity of printing medium, E is a permeability of printing medium (opening in above table 4), F is a substantial permeability (coefficient), G is a solid material (carbon particle and organic resin) in the printing medium.

Moreover, in this invention, the printing is carried out within a thermostatic and humidistat room, the printing medium is supplied onto the screen from a hermetically sealed reservoir, the squeegee is moved forward and backward on the screen, and thereby the printing medium is applied on the ceramic sheet 1.

Viscosity and fluidity of printing medium is kept constant by executing the printing in the thermostatic and humidistat room and moreover since vaporization of organic solvent contained in the printing medium becomes constant, change of screen permeability of printing medium can be suppressed.

Following performance is required for the screen printer.

The squeegee pressure is constant at both right and left sides of squeegee.

The squeegee pressure is constant at the start and the end of printing.

There should be no change in moving velocity of the squeegee. So that the specified amount of printing medium can be left on the screen, after printing sepration of the screen and the ceramic sheet is easily performable.

There should be no dent or mound nor distortion on the vacuum board which supports and fixes the ceramic sheet from below. The squeegee should answer the following requirements: 65~95 degrees for the hardness (rubber hardness), 5°~20° for the angle (the angle of squeegee to the line perpendicular to the silk screen) and 0.5~5 kg/cm² for the pressure (at each end of the squeegee).

As stated above, according to this invention the kind and diameter of screen yarn, screen opening and screen thickness are suitably set and printing is operated in a thermostatic and humidistat room, so that the thickness of the printing medium on the ceramic sheet can be appropriately selected, and moreover, it is feasible to keep the thickness of the coating layer constant to a maximum extent and obtain a high precision of the product.

Thus the heat radiating sheet body according to the invention can have a high quality and can be produced at a high productivity.

The ceramic sheet coated with the printing medium is dried after it is baked or not baked according to the particular temperature at which the heat radiating sheet body is used.

The baking is carried out in case the heat radiating sheet body is to be used at a temperature of 150°~1000° C. and the baking temperature is set to 400°~700° C.

In case the baking is omitted, the ceramic sheet is heated and dried up under a temperature of a room temperature to 150° C.

When the ceramic sheet is baked, the carbon particle layer is formed on the ceramic sheet.

When baked, the organic resin in the printing medium is partly decomposed and vaporized. Other part of it is further polymerized by decomposition remaining thereon and functions as a binder of carbon particle.

The organic solvent is eliminated by vaporization.

In this invention, the carbon particle layer can also be formed by dipping the ceramic sheet into a mixture of carbon particle - dispersing medium.

In this case, an amount of coat can be controlled in accordance with concentration of carbon particle in the mixture of carbon particle - dispersing medium and a velocity of ceramic sheet which passes in such a mixture.

Drying by heating after dipping or baking are conducted as described above.

Thickness of carbon particle in this invention is 8~300μ, or 2.5~300 g/m² in amount of carbon particle and more desirably 10~100 g/m².

If thickness of carbon particle layer is under 2.5 g/m², it is too thin to provide the heat radiating function. If thickness exceeds 300 g/m², there is no difference on the heat radiating function and it is not desirable from the economical point of view.

Thereafter, a pair of electrodes 3, 3 are formed by applying a conductive paint, for example, a silver/copper system paint or copper system paint on the carbon particle layer 2, or applying a conductive paint under the carbon fiber filament or by bonding copper lead, copper foil, and other conductive metal lead and conductive metal foil on the carbon particle layer.

After forming a pair of electrodes 3, 3, the terminals 4, 4 are fixed to the end of respective electrodes 3, 3 and the lead 5 is connected to such terminals. Thereby, a heat radiating sheet body can be used in practice.

An amount of heat to be radiated of a heat radiating sheet body can also be controlled by change of interval between electrodes.

A heat radiating sheet body of this invention can be used in such a condition that the carbon particle layer is exposed but it is desirable to laminate a synthetic resin films 5, 5 to both surfaces of a heat radiating sheet body in order to enhance strength and electrical insulation of a heat radiating sheet body.

As a laminate film, a polyester film or polyimide film are often used but it is desirable to use a polyimide film from the point of view of heat resistivity.

Figure 3:
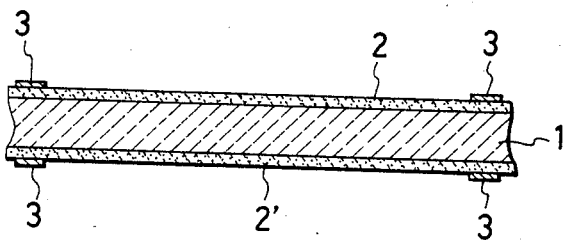
Fig. 3 is an enlarged cross-sectional view illustrating a second embodiment of this invention.

FIG. 3 shows a second embodiment of this invention, where the carbon particle layers 2, 2' are formed in both sides of the ceramic sheet 1.

In this case, the carbon particle layer 2 is printed to the single surface ceramic sheet 1 by above method and the carbon particle layer 2' is also printed in the same way to the other surface and finally these are baked and thereby a heat radiating sheet body can be obtained.

In this second embodiment, it is possible to constitute that a total thickness of carbon particles 2, 2' formed in both sides of ceramic sheet 1 corresponds to the thickness of carbon particle layer in said first embodiment and respective thickness of carbon particle layers 2, 2' is independently selected within the range of thickness of the carbon particle layer, recited before.

The electrode 3 is provided in both sides of ceramic sheet.

Figure 4:
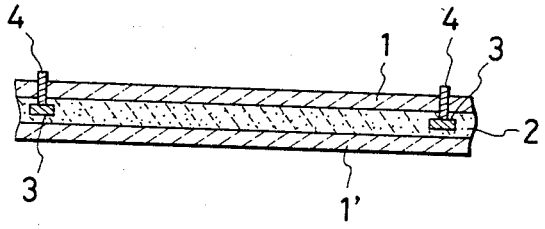
FIG. 4 is an enlarged cross-sectional view indicating a third embodiment of this invention.

FIG. 4 shows a third embodiment where the ceramic sheets 1, 1' are provided to both surfaces of carbon particle layer 2.

In this third embodiment, the carbon particle layer 2 is formed by the printing in the same way as said first embodiment to a single surface of the ceramic sheet 1, other ceramic sheet 1' is further printed on this carbon particle layer 2, and finally these are baked.

Here, a total thickness of ceramic sheets 1, 1' corresponds to the thickness of ceramic sheet of said first embodiment.

The electrode 3 is provided in the carbon particle layer and the terminal 4 which is extended to the ceramic sheet from this electrode is also provided to this layer.

Figure 5:
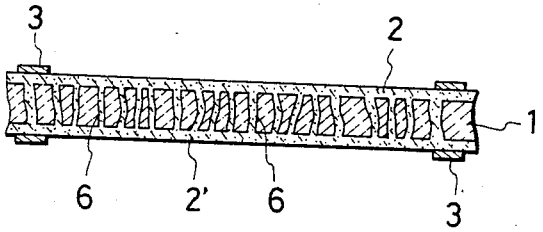
FIG. 5 is an enlarged cross-sectional view representing a fourth embodiment of this invention.

FIG. 5 is a fourth embodiment of this invention where the ceramic sheet 1 is porous and the carbon particle layers 2, 2' are formed at both surfaces of this sheet.

Moreover, since the ceramic sheet 1 is porous, the printing medium penetrates into the holes 6 when the carbon particle layer is formed by printing or dipping and thereby the upper carbon particle layer 2 and lower carbon particle layer 2' are coupled each other through the carbon particles in the holes 6.

In this fourth embodiment, the electrodes are respectively provided at the carbon particle layers 2, 2'.

According to the heat radiating sheet body described above, an electrical resistance value little changes even when a temperature of heat radiating sheet body has increased by power supply.

Considered as a reason is that the carbon particle has small thermal expansion coefficient and a specific resistance increases a little due to a temperature rise but a ceramic sheet has small thermal expansion coefficient and a specific resistance decreases a little due to a temperature rise. After all, the specific resistances of carbon particle and ceramic are cancelled each other and accordingly, the specific resistance of a heat radiating sheet body as a whole little changes even when a temperature rises.

In the heat radiating sheet body of this invention, a heat radiating temperature is determined in accordance with thickness of carbon particle layer formed on the ceramic sheet and thickness of ceramic sheet and this temperature can be kept constant.

Since the carbon particle layer can be formed on the surface of ceramic sheet with a simple method such as printing or dipping, the heat radiating sheet body can be easily mass-produced. As a result, manufacturing cost can be lowered.

Moreover, in the case of this invention, since the carbon particle layer can be formed by the screen printing or dipping of ceramic sheet into the printing medium, thickness of carbon particle layer can be unified and uneven thickness of carbon particle layer can be almost prevented.

Hence, there is no orientation in electrical resistance and fluctuation in electrical resistance of each product can be prevented as much as possible.

As a result, a heat radiating sheet body having high quality can be manufactured with a high yield.

Furthermore, since the carbon particle layer is formed by printing or dipping, thickness of carbon particle can be freely changed and a heat radiating sheet body in the desired thickness of carbon particle layer corresponding to a heat radiating temperature can be manufactured easily.

In addition, an electrical resistance can be changed freely by changing thickness of carbon particle layer and thereby a heat radiating temperature can be easily set to the wanted value.

As described above, since an electric resistance value does not change due to a temperature and a ceramic sheet is used, the heat radiating sheet body of this invention is just superior in safety and heat resistivity and can prevent generation of trouble such as firing, etc.

Since the carbon particle layer is formed on the surface of ceramic sheet, the heat radiating sheet body thus obtained is very flexible.

Thereby, the heat radiating sheet body of this invention can be used in a wide application field where the existing heat radiating sheet body could not be used. For example, it can be installed within walls or floors for a heating purpose, or can be provided within clothes utilizing its flexibility also for the heating purpose. Moreover, it can also be used for heating purpose in agricultural field, livestock industry and gardening, or for heat insulation and heating for pipe, valve and tank, etc. and/or as electrical parts, etc.

Reported hereinafter are results of tests conducted of the heat radiating sheet body of this invention.

Test 1

With polytetrafluoroethylene resin as binder, a papermaking was operated of aluminosilicate fibers, and a ceramic sheet having the thickness of 0.3 mm was prepared. After it was baked at 550° C., the sheet was coated by silk-screen printing method with a printing medium comprising carbon black, aclyric resin and acetone. The coated sheet was then baked at 600° C. and a carbon particle layer having 13 g/m$^2$ for the amount of carbon was formed.

Then, a pair of electrodes were formed by coating a silver paint at spaced points on the surface of the carbon particle layer to obtain a heat radiating sheet body.

The heat radiating sheet body obtained above was 30 cm long and 10 cm wide, the electrodes being formed along the longitudinal edge of the body.

On a wood plate (A) of the size of 20 mm×300 mm×300 mm, another wood plate of the size of 5 mm×500 mm×500 mm was placed, and the heat radiating sheet body was laid over the latter wood plate (B).

100-V AC current was passed through the heat radiating sheet body, and the temperature and the electrical resistance of the sheet body were measured once for every five minutes.

Figure 6:
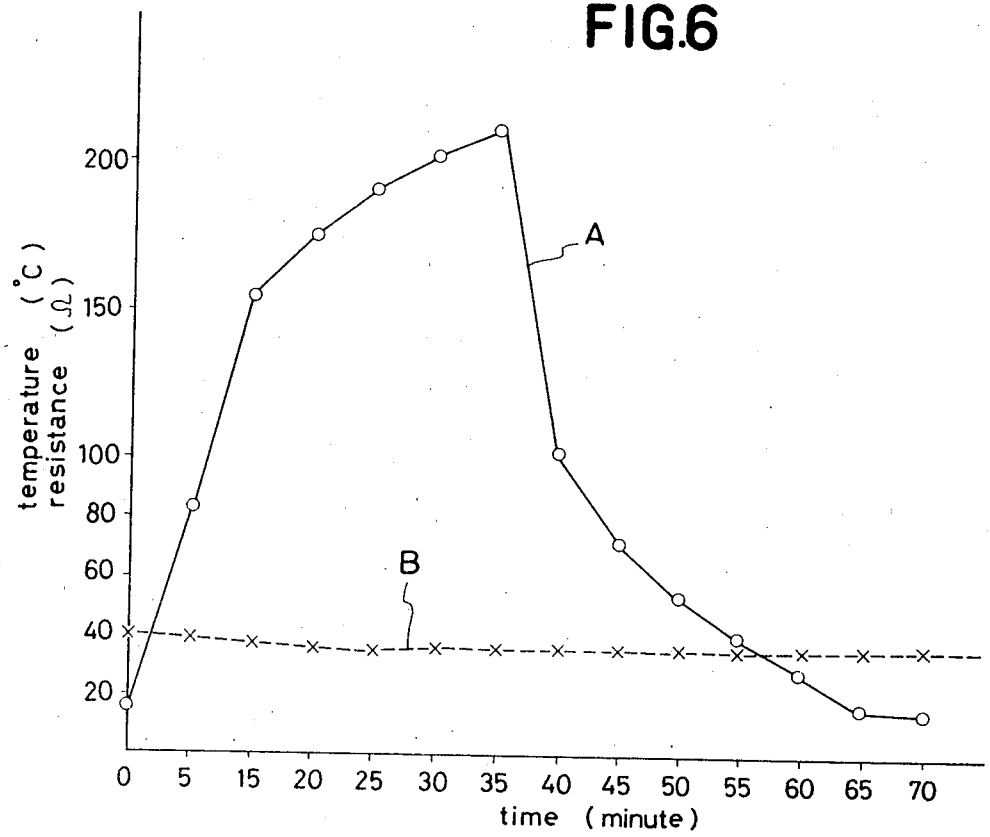
FIGS. 6, 7 and 8 respectively show the relation between the power supply period and the temperature and electrical resistance value of a heat radiating sheet body of this invention.

A result is shown in FIG. 6. In FIG. 6, the curve A indicates temperature of the heat radiating sheet body, while curve B indicates electrical resistance of carbon particle layer.

After 20 minutes from start of supplying electrical power, a small amount of smoke was generated at a temperature of about 170° C. After 30 minutes, amount of smoke increased at a temperature of about 200° C. After 35 minutes, supply of power was stopped at a temperature of about 210° C.

As a result, both sides of wooden plate (B) were burned and changed in color to light yellow and the surface of wooden plate (A) in contact with the plate (B) was also burned a little.

However, any abnormal phenomenon could not be found on the heat radiating sheet body.

As is apparent from FIG. 6, the heat radiating sheet body did not show any change of electrical resistance even when it showed change of temperature.

In case this heat radiating sheet body was placed on a heat resistant brick in place of a wooden plate and the electrical power was supplied, temperature reached 205° C. after about 30 minutes and thereafter the temperature could be kept constant stably.

Test 2

The printing medium similar to that used in the Test 1 was applied, by the silk-screen printing method, on the surface of ceramic sheet in the thickness of 300μ manufactured as in the case of Test 1, and a carbon particle layer with amount of carbon of 11 g/m$^2$ was formed.

No baking was conducted at the time of the making of the ceramic sheet and even after the printing. Namely, the ceramic sheet was only dried up by heating.

Next, the surface of carbon particle layer was coated with a silver paint in order to form a pair of electrodes, thereby completing a heat radiating sheet body.

A heat radiating sheet body thus obtained was sized by 40 cm in longitudinal and by 30 cm in lateral.

Wood plates (A) and (B) similar to those used in the Test 1 were placed as in the case of Test 1, and a heat radiating sheet body was placed on wooden plate (B).

Figure 7:
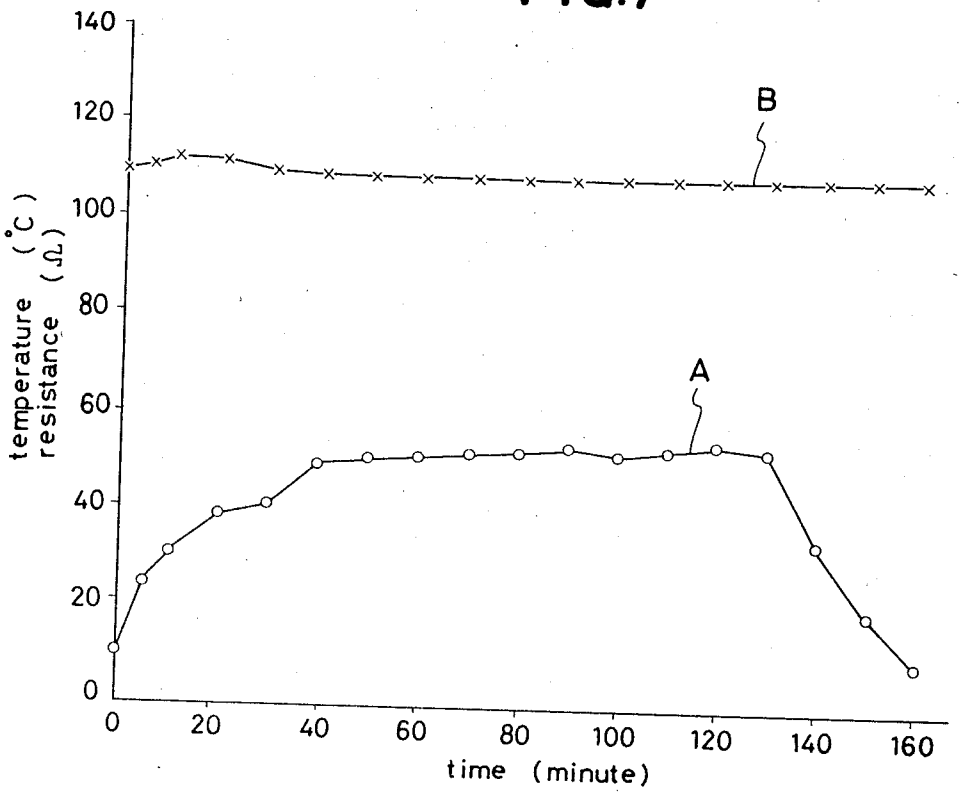

An electrical power was supplied to said heat radiating sheet body and temperature and electrical resistance value were measured once for every 10 minutes. FIG. 7 shows the result of the measurement.

In FIG. 7, the curve A indicates temperature of the heat radiating sheet body and a curve B indicates electrical resistance of carbon particle layer.

After about 40 minutes from start of supplying of electrical power, temperature was almost constant at about 52°~55° C. After 130 minutes, supply of electrical power was stopped.

Meanwhile, an electrical resistance value was almost constant and it was not changed even after the supply of power was stopped.

Test 3

A printing medium similar to that used in the Test 1 was applied on the surface of ceramic sheet manufactured as in the case of Test 1 by the silk-screen printing method, and a carbon particle layer with amount of carbon of 9 g/m$^2$ was formed.

The heat radiating sheet body thus obtained was sized by 25 cm×25 cm.

Thickness of ceramic sheet was 300μ. After the paper-making and the printing, no baking was operated.

A pair of electrodes were formed with the silver paint on the surface of carbon particle layer, thus completing manufacture of the heat radiating sheet body.

The wooden plates (A) and (B) similar to those used in the Test 1 were placed as in the case of Test 1, the heat radiating sheet body was also placed on the plate (B).

Figure 8:
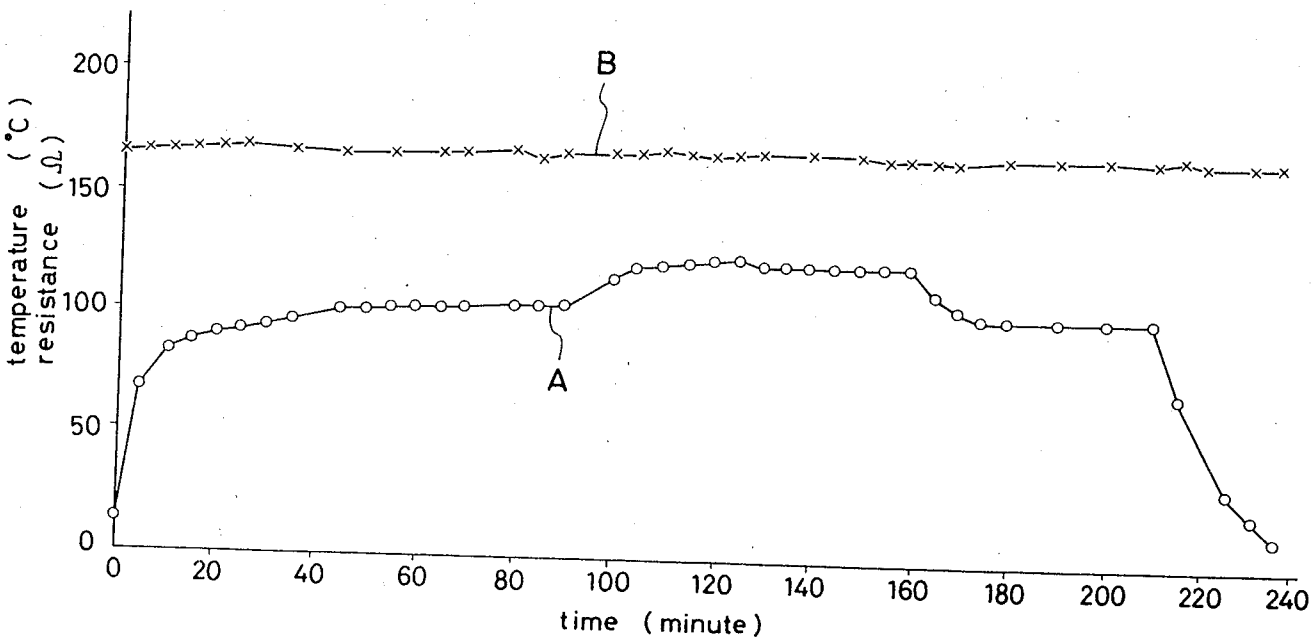

An electrical power was supplied to the heat radiating sheet body, and temperature and electrical resistance values were measured once in every 5~10 minutes. The result is shown in FIG. 8. In FIG. 8, the curve A indicates temperature of heat radiating sheet body and the curve B indicates resistance value of carbon particle layer.

After about 60 minutes from start of supplying electrical power, temperature was stabilized at about 100° C. Therefore, after about 90 minutes, entire part of heat radiating sheet body was covered with a foamed polyulethane sheet in the thickness of about 3 mm in order to store the heat.

After the coverage, temperature reached about 120° C. after 15 minutes and thereafter the temperature was stabilized.

Therefore, the polyulethane sheet was removed after 60 minutes from coverage. Thereby, temperature returned, in about 20 minutes, to the surface temperature (about 100° C.) before the polyulethane was covered and stable temperature was kept. Moreover, after 30 minutes, supply of electrical power was suspended, and the sheet body was left to cool naturally.

Although the heat radiating sheet body was subjected, as above, under various conditions such that it was not covered with a foamed polyurethane sheet and such that it was once covered with a foamed polyurethane sheet and then removed of the sheet covering, its electrical resistance (ohm) showed substantially no change and it constantly showed an electrical resistance of about 115 ohms.

I claim:

1. A heat radiating sheet body comprising:

(a) a flexible sheet having as a major component thereof ceramic fibers;

(b) a carbon particle layer, adhered to at least one surface of said ceramic fiber containing flexible sheet, said carbon particle layer having a surface thickness which is essentially even and uniform over the surface of said ceramic fiber containing flexible sheet, and (c) a pair of electrodes disposed on said carbon particle layer so that there is a space between the electrodes.

2. A heat radiating sheet body according to claim 17, wherein said flexible sheet has a thickness of 0.05 to 1 mm.

3. A heat radiating sheet body according to claim 17, wherein said carbon particle layer has a thickness corresponding to 2.5 to 300 g/m$^2$.

4. A heat radiating sheet body according to claim 17, wherein said flexible sheet is produced by paper-making of ceramic fiber in the presence of a binder.

5. A heat radiating sheet body according to claim 4, wherein said binder is composition selected from a group of an organic binder or a barium based inorganic binder.

6. A heat radiating sheet body according to claim 4, wherein said flexible sheet formed into a paper form is baked at a temperature of 250° to 700° C.

7. A heat radiating sheet body according to claim 17, wherein said carbon particle layer is formed by coating by a screen printing method using a printing medium comprising carbon particle and a dispersing medium, followed by heating to dry.

8. A heat radiating sheet body according to claim 17, wherein said carbon particle layer is formed by dipping said flexible sheet into a mixture of carbon particle and a dispersing medium, followed by heating to dry.

9. A heat radiating sheet body according to claim 7, wherein said dispersing medium is a mixture of an organic resin and an organic solvent.

10. A heat radiating sheet body according to claim 8, wherein said dispersing medium is a mixture of an organic resin and an organic solvent.

11. A heat radiating sheet body according to claim 9, wherein said organic resin is a composition selected from a group of a liquid polyethyleneterephthalate resin, a liquid acrylic resin, a liquid alkyd resin and a liquid polytetrafluoroethylene resin.

12. A heat radiating sheet body according to claim 9, wherein said organic solvent is a composition selected from a group of ketone and, aromatic solvent.

13. A heat radiating sheet body according to claim 7, wherein said carbon particle layer formed by screen printing is baked at a temperature of 400° to 700° C.

14. A heat radiating sheet body according to claim 8, wherein said carbon particle layer formed by dipping is baked at a temperature of 400° to 700° C.

15. A heat radiating sheet body according to claim 7, wherein said carbon particle layer formed by screen printing is dried at a temperature of room temperature 150° C.

16. A heat radiating sheet body according to claim 8, wherein said carbon particle layer formed by dipping is dried at a temperature of room temperature to 150° C.

17. A heat radiating sheet body according to claim 6, wherein said binder is a composition selected from a group of an organic binder and a barium based inorganic binder.

* * * * *